US006931813B2

(12) United States Patent
Collie

(10) Patent No.: US 6,931,813 B2
(45) Date of Patent: Aug. 23, 2005

(54) TORNADO AND HURRICANE ROOF TIE

(76) Inventor: Anthony D. Collie, P.O. Box AP-59004 Kennedy Subdivision, New Providence (BS)

( * ) Notice: Subject to any disclaimer, the term of this patent is extended or adjusted under 35 U.S.C. 154(b) by 194 days.

(21) Appl. No.: 10/604,443

(22) Filed: Jul. 22, 2003

(65) Prior Publication Data

US 2004/0107653 A1 Jun. 10, 2004

Related U.S. Application Data

(63) Continuation-in-part of application No. 10/211,138, filed on Aug. 2, 2002, now Pat. No. 6,837,019.

(51) Int. Cl.[7] ..... E04B 1/38
(52) U.S. Cl. ..... 52/713; 52/702; 52/92.2
(58) Field of Search ..... 52/702, 712, 713, 52/715, 92.2, 93.1

(56) References Cited

U.S. PATENT DOCUMENTS

| | | | | | |
|---|---|---|---|---|---|
| 3,256,030 | A | | 6/1966 | Banse | |
| 3,333,875 | A | * | 8/1967 | Tracy | 403/170 |
| 3,423,898 | A | * | 1/1969 | Coloney et al. | 52/713 |
| 4,449,335 | A | | 5/1984 | Fahey | |
| 4,498,801 | A | * | 2/1985 | Gilb | 403/232.1 |
| 4,527,375 | A | | 7/1985 | Braginetz | |
| 4,592,186 | A | * | 6/1986 | Braginetz | 52/699 |
| 4,714,372 | A | | 12/1987 | Commins | |
| 4,841,690 | A | | 6/1989 | Commins | |
| 4,932,173 | A | | 6/1990 | Commins | |
| 5,109,646 | A | * | 5/1992 | Colonias et al. | 52/712 |
| 5,150,982 | A | | 9/1992 | Gilb | |
| 5,230,198 | A | | 7/1993 | Callies | |
| 5,423,156 | A | * | 6/1995 | Nellessen, Jr. | 52/715 |
| 5,481,844 | A | | 1/1996 | Kajita | |
| 5,488,810 | A | | 2/1996 | Horton | |
| 5,555,694 | A | * | 9/1996 | Commins | 52/702 |
| 5,857,295 | A | | 1/1999 | Mikawa | |
| 6,295,781 | B1 | | 10/2001 | Thompson | |
| 6,519,908 | B1 | | 2/2003 | Masterson et al. | |
| 6,560,943 | B1 | | 5/2003 | Leek et al. | |
| 6,658,806 | B1 | | 12/2003 | Leek | |

* cited by examiner

*Primary Examiner*—Brian E. Glessner
(74) *Attorney, Agent, or Firm*—Whiteford, Taylor & Preston LLP; Jeffrey C. Maynard; Gregory M. Stone

(57) ABSTRACT

A building roof tie for attaching roof trusses and rafters to wood top plates in building structures, such roof tie having a sheet metal body with risers and a bridge for overlapping a rafter and flaps for wrapping on the sides of the top plate. A generally triangular shaped reinforcing wing provides strength and stability, and can also provide additional hold-down strength, allowing the roof tie to be manufactured from different weights of steel. Turnbuckles attached to the bridge provide additional hold-down strength against increased uplift forces. The roof ties are pitched to conform to a variety of framing applications. A plurality of apertures is formed in the roof tie to provide openings for fasteners for connecting the tie to the wood top plate and rafter.

20 Claims, 10 Drawing Sheets

TORNADO AND HURRICANE ROOF TIE

CROSS REFERENCE TO RELATED APPLICATIONS

This application is a continuation-in-part of and co-owned U.S. patent application Ser. No. 10/211,138, entitled "Tornado and Hurricane Roof Tie", filed with the U.S. Patent and Trademark Office on Aug. 2, 2002 now U.S. Pat. No. 6,837,019 by the inventor herein, the specification of which is included herein by reference.

BACKGROUND OF INVENTION

1. Field of the Invention

This invention relates generally to building structures with wood roofs, and more particularly to structures exposed to extreme wind conditions, such as Tornadoes and Hurricanes, where building codes dictate that such structures be protected against structural failure to save lives of occupants. In particular, the present invention relates to a roof tie for anchoring a wood frame roof on a block construction building in order to resist uplift forces encountered during a high wind situation.

2. Background of the Prior Art

It is well known what high winds can do to a building, particularly to a wood frame construction low-rise structure. Generally, uplift forces tending to lift the roof off the structure or the entire structure off its foundation cause much of the damage sustained by the building.

Wood structures predominate in residential and light commercial construction, and when wood framing is employed, the structure must be protected from upward loads developed by high wind, which differs with geographical location and is enforced by different building codes for such areas. For example, the Bahamas and Florida, including the Florida Keys are situated in the pathway of the yearly Caribbean hurricane travel course and as such, encounter hurricanes and/or tornadoes from time to time. Houses in the Bahamas are typically constructed of cement block with a wooden top plate fastened to the top of cement block walls, for attaching a wooden roof. In the case of upward loads, the roof is generally tied to the walls using a variety of steel connectors that tie the top plate to the walls. The size and number of these steel connectors vary depending on the severity of the wind conditions in the locality of the building, and the building's geometry. Due to the house location in a susceptible high wind area, some building codes require that houses built with wooden roof support beams have a "Hurricane Tie" in place on every rafter."

Hurricane Ties" are usually installed during the foundation and framing stages of construction. Laborers hired by the framing contractor generally install connectors and sheathing. Correct size, location, and number of fasteners (nails or bolts) are critical to sustaining the required load. Commonly, such laborers are inexperienced which results in improper or inadequate installation. In all structures, locations of connectors mandate their installation during the framing stage due to related components being placed at the same time. This process slows the foundation and framing stages of construction, which in turn increases labor costs.

From the foregoing, it is apparent that there is a critical need for a strong roof tie system that provides for uplift loads which is cost effective and easy to install.

SUMMARY OF INVENTION

The present invention provides a solution to the above and other problems by reinforcing and anchoring the roof structure to the building top plate, wherein a hold down force is applied to the ceiling rafters to counter the uplift and horizontal forces generated by high winds. The present invention can be incorporated during initial construction of a wooden roof structure.

It is an object of the present invention to provide a rooftie bracket system for a wooden roof structure of a building that reinforces the roof against damage in a high wind situation, such as a hurricane.

It is another object of the present invention to provide a roof-tie bracket system for a wooden roof construction building that provides a downward force around the periphery of the roof, thereby to better resist upward lift imparted to the roof by high winds.

It is another object of the present invention to provide a roof-tie bracket system for a wood frame roof that provides reinforcement to the roof structure, thereby providing greater resistance to damage during high wind conditions. A related object is to increase public safety in structures existing in high wind areas.

It is yet another object of the present invention to enable cost effective construction of wooden roof structures while meeting all building code requirements. A related object is to provide a roof-tie bracket system for a lowrise building that complies with the recommendation of all major building codes.

This invention relates to a novel roof-tie bracket system for bracing a wood framed roof of a building, e.g., a residential dwelling, having a structure including a foundation upon which rests a wall construction and horizontal ceiling plates. The structure is reinforced against the destructive forces of the atmosphere by high strength brackets preferably attached to every rafter where it joins the ceiling plates. The roof-tie bracket is connected to the structure by way of a plurality of fasteners, such as nails or lag bolts.

The roof-tie bracket disclosed herein offers more body, more nailing surfaces, more wrapping capability, more strength, and more durability to the purchasing public. Such roof-tie brackets may be made from a graduated increase in sheet metal gauges in a variety of straps or ties to fit many framing applications and strength requirements. Moreover, such roof-tie brackets may be prepitched to a predetermined angle of a roof, keeping in mind the different sizes of wood that may be used to pitch a roof. Such roof-tie brackets create a solid attachment between a rafter and ceiling top plate. This simple invention enables a family of roof-tie brackets that can be mass-produced and sold for a reasonable price that, in fact, can be made or put in place by any skilled or semiskilled person.

Some of the advantages of this invention include: increase in surface area of a roof-tie bracket, thereby creating more surfaces through which nails could penetrate the substructure; "prepitched" roof-tie brackets that create a snug fit over all substructures and angles, at angles consistent with industry roof pitch standards; a "decking window" that allows fastening of nails through the "deck" to the rafter beneath; "plate flaps" that further secures the roof-tie bracket to the top plate; and, in some embodiments, a "ceiling joist and cradle" that provides further for the "strapping" of ceiling joists, all in one simple Hurricane and Tornado Tie.

BRIEF DESCRIPTION OF DRAWINGS

The above and other features, aspects, and advantages of the present invention are considered in more detail, in relation to the following description of embodiments thereof shown in the accompanying drawings, in which.

DETAILED DESCRIPTION

The invention summarized above and defined by the enumerated claims may be better understood by referring to the following description, which should be read in conjunction with the accompanying drawings in which like reference numbers are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1A:
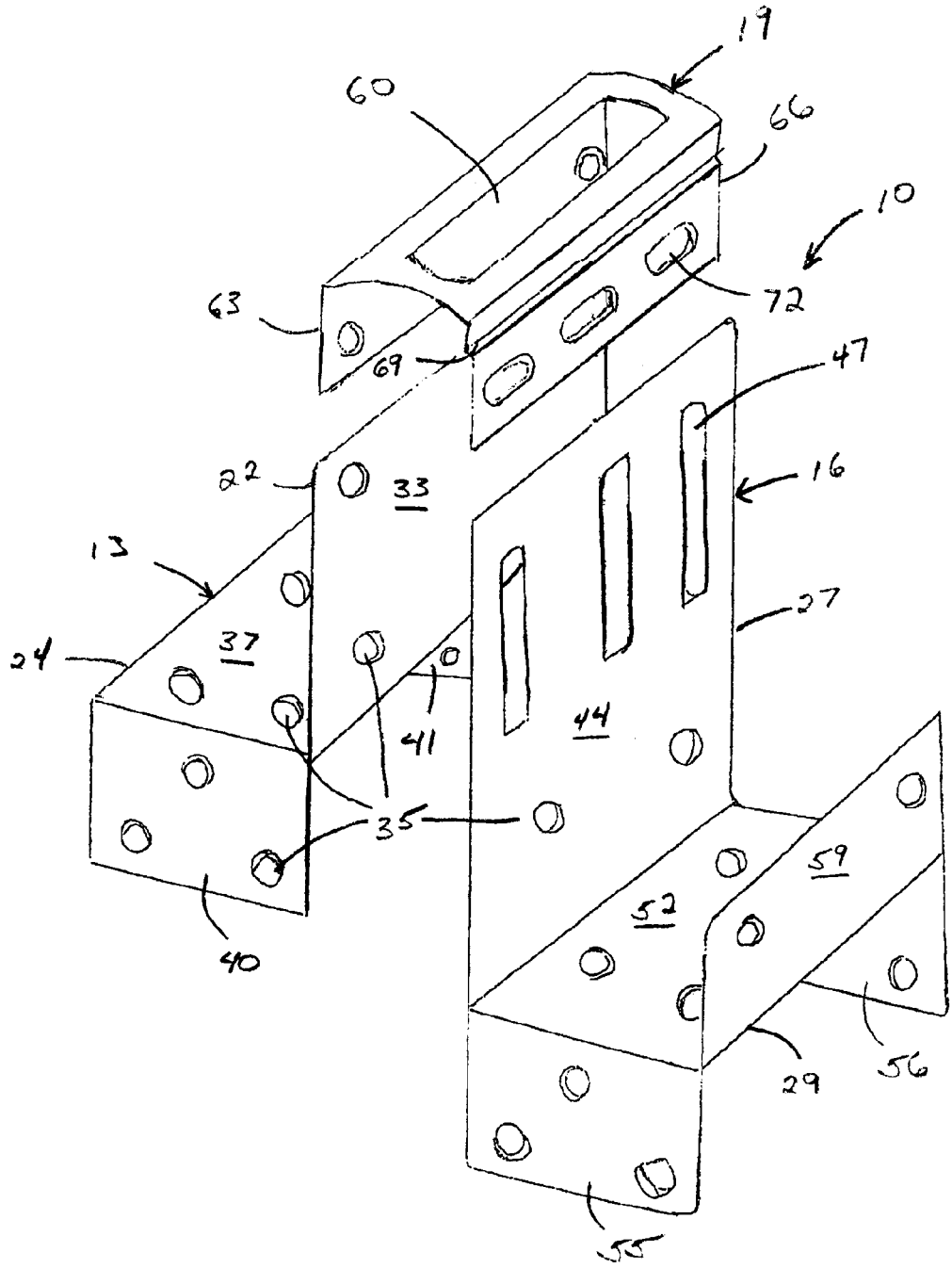
FIG. 1*a* shows an illustration of a roof tie in perspective according to one embodiment of the present invention.

Referring to FIG. 1*a*, a roof tie according to the present invention, indicated generally as 10, is illustrated, comprising a tie component 13, a cradle component 16, and a bridge component 19, such tie component 13 having an upper portion 22 and a lower portion 24 and such cradle component 16 having an upper portion 27 and a lower portion 29. Such upper portion 22 of such tie component 13 comprises a riser 33 having a plurality of apertures 35. The lower portion 24 of such tie component 13 comprises fastener extension 37, which extends at a right angle from riser 33 and further comprises top plate flaps 40, 41. A plurality of apertures 35 for inserting fasteners, such as nails are disposed on such fastener extension 37, and top plate flaps 40, 41. Such upper portion 27 of such cradle component 16 comprises a wall 44 having a plurality of apertures 35 and at least one fastener slot, such as 47. The lower portion 29 of such cradle component 16 comprises fastener extension 52, which extends at a right angle from wall 44 and further comprise top plate flaps 55, 56 and cradle wall 59. Cradle wall 59 is disposed on an outward edge of fastener extension 52 and extends upward, substantially perpendicular to such fastener extension 52. In general, cradle wall 59 is preferably shorter than and substantially parallel to wall 44. A plurality of apertures 35 for inserting fasteners, such as nails, are disposed on such fastener extension 52, top plate flaps 55, 56, and cradle wall 59. Such plurality of apertures should be disposed in a staggered fashion to prevent splitting of the top plate and rafters when inserting such fasteners.

Bridge component 19 presents a large window area 60 to permit fastening decking to a rafter. Such bridge component 19 should be wide enough to conform to the standard thickness of construction materials, such as wooden 2×4s. Bridge component 19 comprises a short riser 63 having a plurality of apertures 35 for fastening such bridge component 19 to a rafter. Bridge component 19 further comprises an overlap plate 66 disposed away from such bridge component 19 by ledge 69 and having at least one opening, such as 72. In use, overlap plate 66 at least partly extends over wall 44. Such fastener slots 47 are disposed such that, in use, fasteners inserted in openings 72 in overlap plate 66 can penetrate such fastener slots 47. By having such overlap, roof tie 10 can adapt to rafters of varying heights for application in a variety of construction scenarios. Fastener slots 47 enable fasteners to be inserted in such a manner to ensure a snug fit for bridge component 19 on the top of a rafter. Overlap plate 66 extends over wall 44 such that fasteners inserted in openings 72 also enter fastener slots 47 at a variable position depending on the height of the rafter for attachment to such rafter.

Figure 1B:
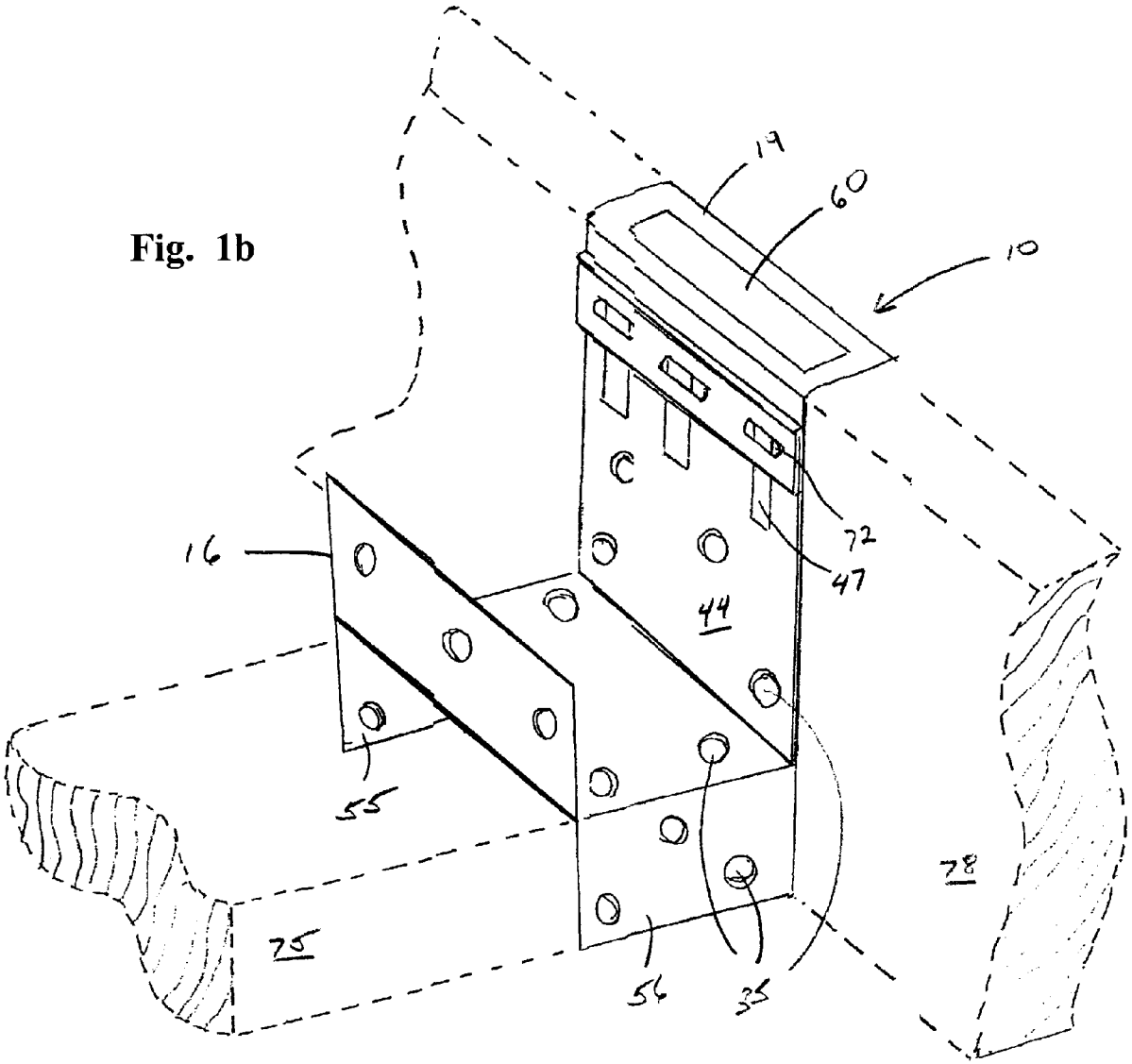
FIG. 1*b* shows an illustration of the roof tie of FIG. 1*a*, with a top plate and rafter in phantom.

An application showing use of such roof tie 10 is illustrated in FIG. 1*b* presenting roof tie 10 in a position for fastening to top plate 75 and rafter 78. Fasteners are attached to top plate 75 and rafter 78 through apertures 35, and through openings 72 in alignment with fastener slots 47. Using a fastener in each opening ensures a strong and secure attachment. Additional embodiments using various numbers of holes can be used based on specific engineering requirements as determined by one skilled in the art. As shown in FIG. 1*b*, top plate flaps 55, 56, are fastened to the sides of top plate 75, providing a wrap around most of such top plate 75. Window area 60 is provided to enable fastening of decking material to rafter 78.

In some embodiments, the length of the forward edge of wall 44 may be longer than the rear edge of such wall 44, correspondingly, the forward edge of riser 33 may be longer than the rear edge of such riser 33 in order to have bridge component 19 angled to correspond to a selected pitch for a roof.

Figure 2A:
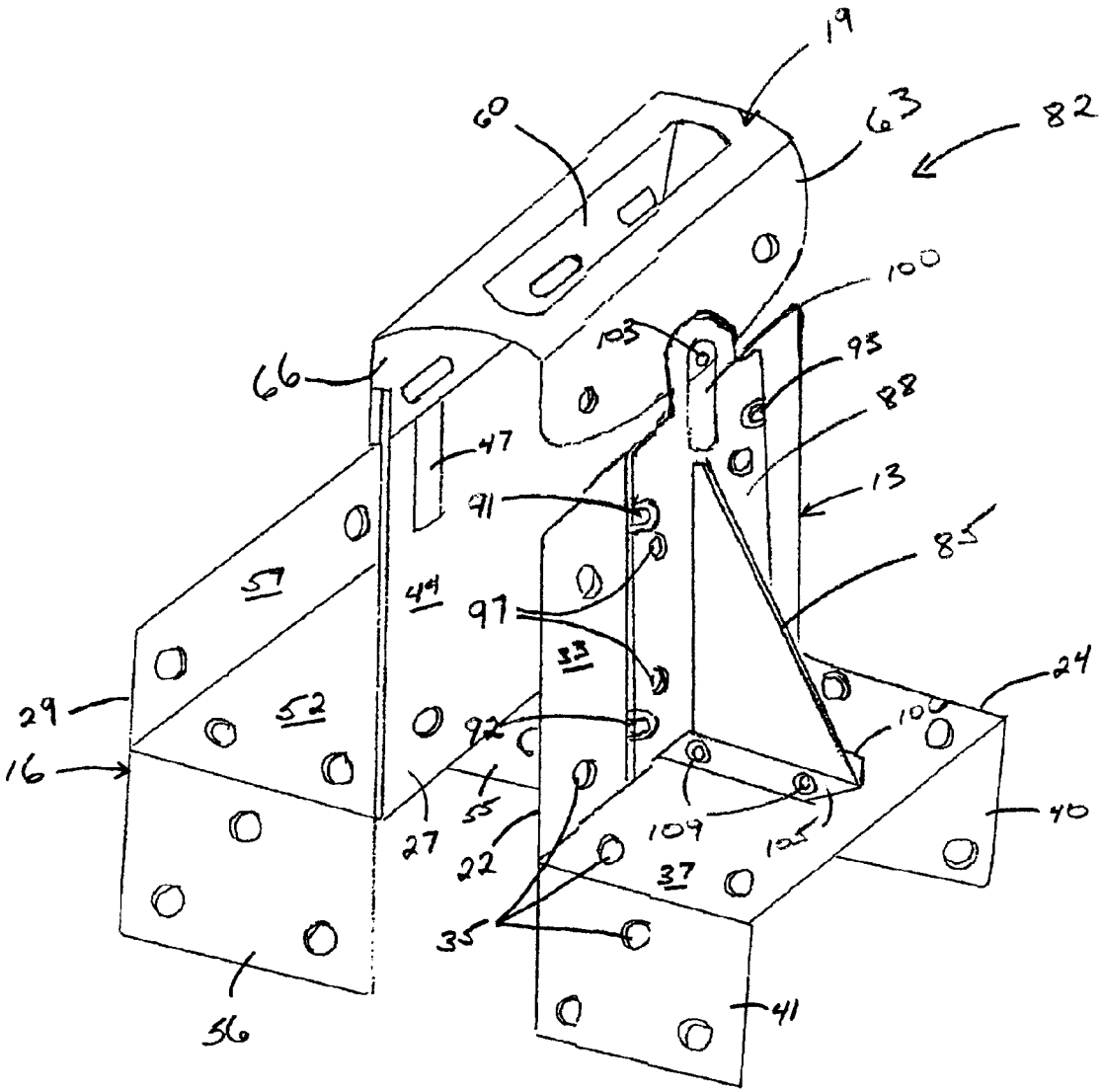
FIG. 2*a* shows an illustration of a roof tie in perspective having a rigidity reinforcement according to one embodiment of the present invention.
Figure 2B:
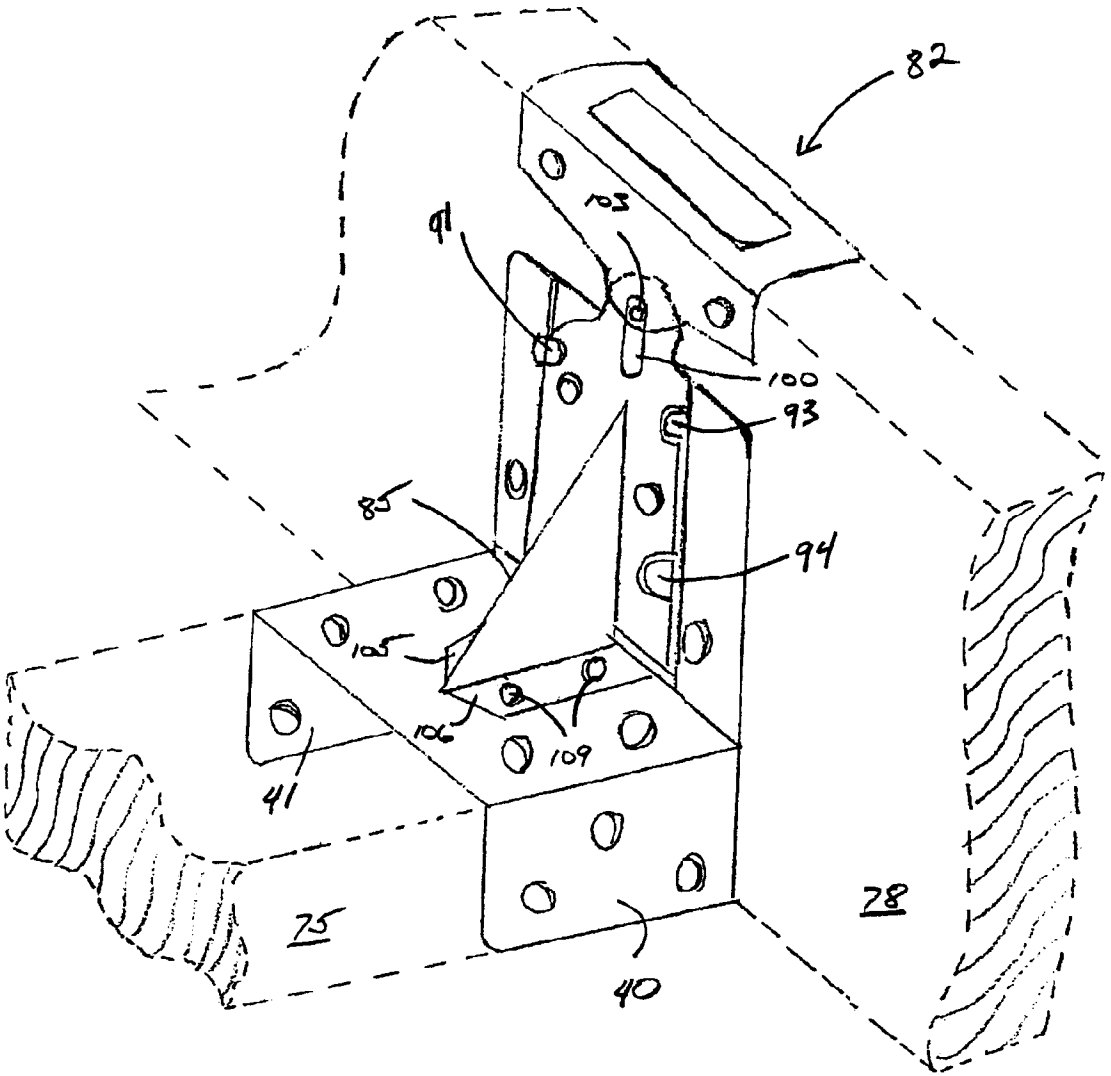
FIG. 2*b* shows an illustration of the roof tie of FIG. 2*a*, with top plate and gable in phantom.

FIGS. 2*a* and 2*b* illustrate an alternate embodiment of a roof tie, indicated generally as 82, according to the present invention. Roof tie 82 comprises a tie component 13, a cradle component 16, and bridge component 19, such tie component 13 having an upper portion 22 and a lower portion 24 and such cradle component 16 having an upper portion 27 and a lower portion 29. Such upper portion 22 of such tie component 13 comprises a riser 33 having a plurality of apertures 35. The lower portion 24 of such tie component 13 comprises fastener extension 37, which extends at a right angle from riser 33 and further comprises top plate flaps 40, 41. A plurality of apertures 35 for inserting fasteners, such as nails are disposed on such fastener extension 37, and top plate flaps 40, 41. Such upper portion 27 of such cradle component 16 comprises a wall 44 having a plurality of apertures 35 and a plurality of fastener slots 47. The lower portion 29 of such cradle component 16 comprises fastener extension 52, which extends at a right angle from wall 44 and further comprise top plate flaps 55, 56 and cradle wall 59. Cradle wall 59 is disposed on an outward edge of fastener extension 52 and extends upward, substantially perpendicular to such fastener extension 52. In general, cradle wall 59 is preferably shorter than and substantially parallel to wall 44. A plurality of apertures 35 for inserting fasteners, such as nails, are disposed on such fastener extension 52, top plate flaps 55, 56, and cradle wall 59. Such plurality of apertures should be disposed in a staggered fashion to prevent splitting of the top plate and rafters when inserting such fasteners.

Bridge component 19 presents a large window area 60 to permit fastening decking to a rafter. Such bridge component 19 should be wide enough to conform to the standard thickness of construction materials, such as wooden 2×4s. Bridge component 19 comprises a short riser 63 having a plurality of apertures 35 for fastening such bridge component 19 to rafter 78. Bridge component 19 further comprises an overlap plate 66 having openings 72. In use, overlap plate 66 at least partly extends over wall 44. Such fastener slots 47 are disposed such that, in use, fasteners inserted in openings 72 in overlap plate 66 can penetrate such fastener slots 47.

For heavy-duty applications, roof tie 82 further comprises a reinforcing wing 85. Such reinforcing wing 85 is generally triangular in shape and extends outward from a plate 88 that can be attached to riser 33 by sliding plate 88 into tabs 91, 92, 93, 94. Holes 97 in plate 88 enable attachment of such plate 88 through riser 33 into rafter 78. The top portion of plate 88 has an extension that can overlap the short riser 63 of bridge component 19 and presents a centrally located elongated opening 100 that aligns with aperture 103 in short riser 63 to attach a fastener into rafter 78. The lower edge of reinforcing wing 85 has a pair of base flaps 105, 106 on each side. Such base flaps 105, 106 have apertures 109 for attaching fasteners therethrough into top plate 75.

Such reinforced heavy duty roof tie 82 provides vertical reinforcement to prevent balking while enabling increased rigidity to roof tie 82, resulting in a sturdier, stronger roof tie 82. Such increased strength can be obtained at reduced cost by enabling use of lower galvanized steel gauges for its construction. Balking is caused by misalignment of trusses due to warping of roof timbers or loosening of fastened joints, resulting in roof decking being heaved up along such misaligned roof truss.

In an alternate embodiment, short riser 63 may present a hook in the place of aperture 103, such that elongated opening 100 can be engaged on the hook while sliding back plate 88 into tabs 91, 92, 93, 94. Attachment of fasteners to base flaps 105, 106 would thereby provide a downward force on such hook and bridge component 19.

Figure 3:
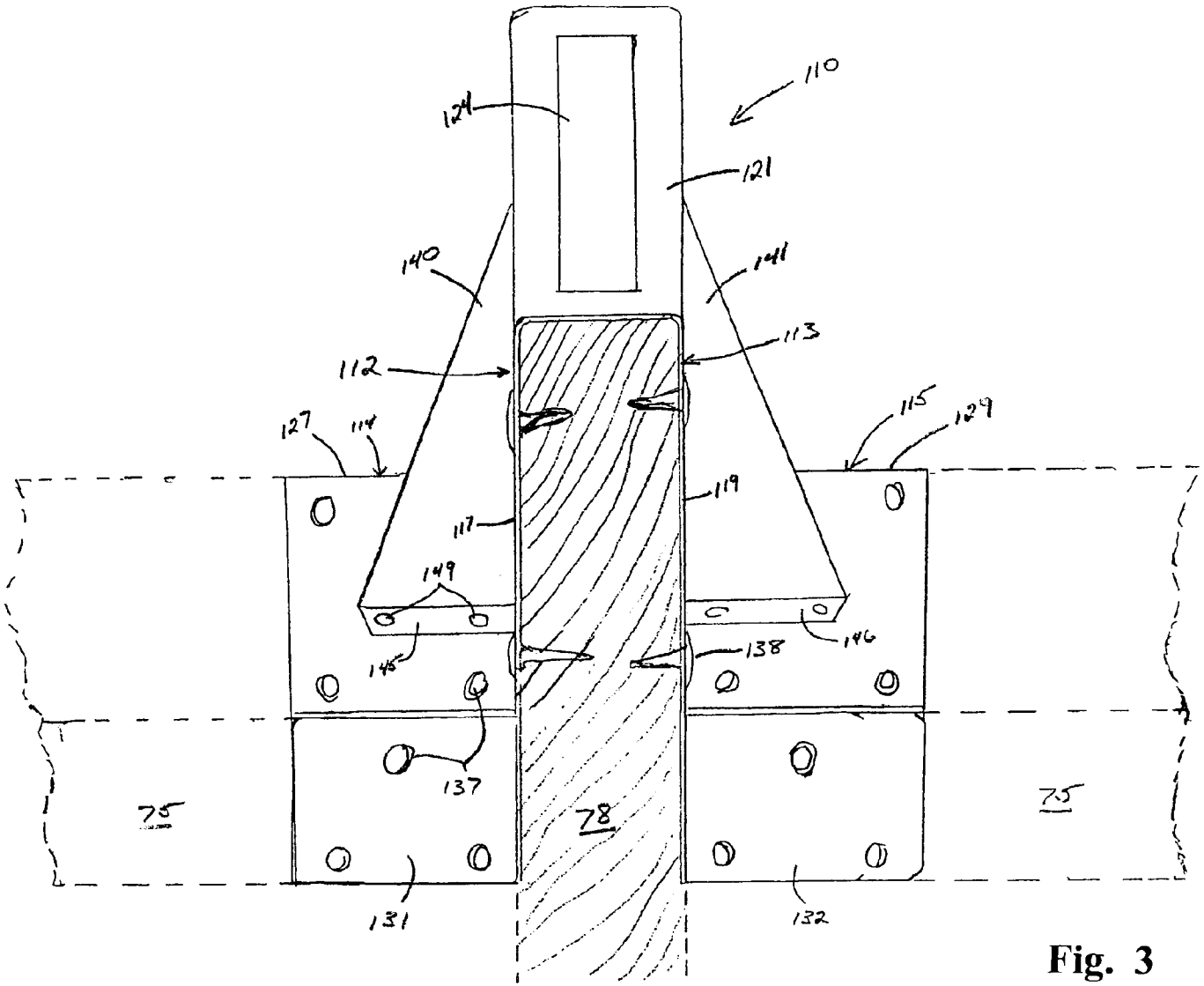
FIG. 3 shows an illustration of a roof tie, according to an alternative to the embodiment in FIGS. 2*a* and 2*b*.

FIG. 3 shows an illustration of an application according to an alternative roof tie embodiment. Roof tie 110 comprises a pair of matching tie component sections, having upper portions 112, 113 and lower portions 114, 115. Such upper portions 112, 113 comprise risers 117, 119, substantially parallel to each other. Bridge 121 presenting a large window area 124 overlaps the top of risers 117, 119. Bridge 121 should conform to the standard thickness of construction materials, such as rafter 78. The lower portions 114, 115 of such roof tie 110 comprise fastener extensions 127, 129, which extend at right angles from risers 117, 119, respectively, each of which fastener extensions 127, 129 further comprise top plate flaps 131, 132, 133 (not shown), 134 (not shown). A plurality of apertures 137 for inserting fasteners, such as nails 138 are disposed on such risers 117, 119, fastener extensions 127, 129, and top plate flaps 131, 132, 133 (not shown), 134 (not shown). Such plurality of apertures should be disposed in a staggered fashion to prevent splitting of the top plates and rafter when inserting such fasteners.

For heavy-duty applications, roof tie 110 further comprises reinforcing wings 140, 141. Such reinforcing wings 140, 141 are generally triangular in shape and extend outward from a plate that can be attached to risers 117, 119, respectively. The lower edge of each reinforcing wing 140, 141 has a pair of base flaps 145, 146 on each side. Such base flaps 145, 146 have apertures 149 for attaching fasteners therethrough into top plate 75.

Such reinforced heavy duty roof tie 110 provides vertical reinforcement to prevent balking while enabling increased rigidity to roof tie 110, resulting in a sturdier, stronger roof tie 110. Such increased strength can be obtained at reduced cost by enabling use of lower galvanized steel gauges for its construction. Balking is caused by misalignment of trusses due to warping of roof timbers or loosening of fastened joints, resulting in roof decking being heaved up along such misaligned roof truss.

In some embodiments, the length of the forward edges of risers 117, 119 may be longer than the rear edges of such risers 117, 119 in order to have bridge 121 angled to correspond to a selected pitch for a roof.

Figure 4A:
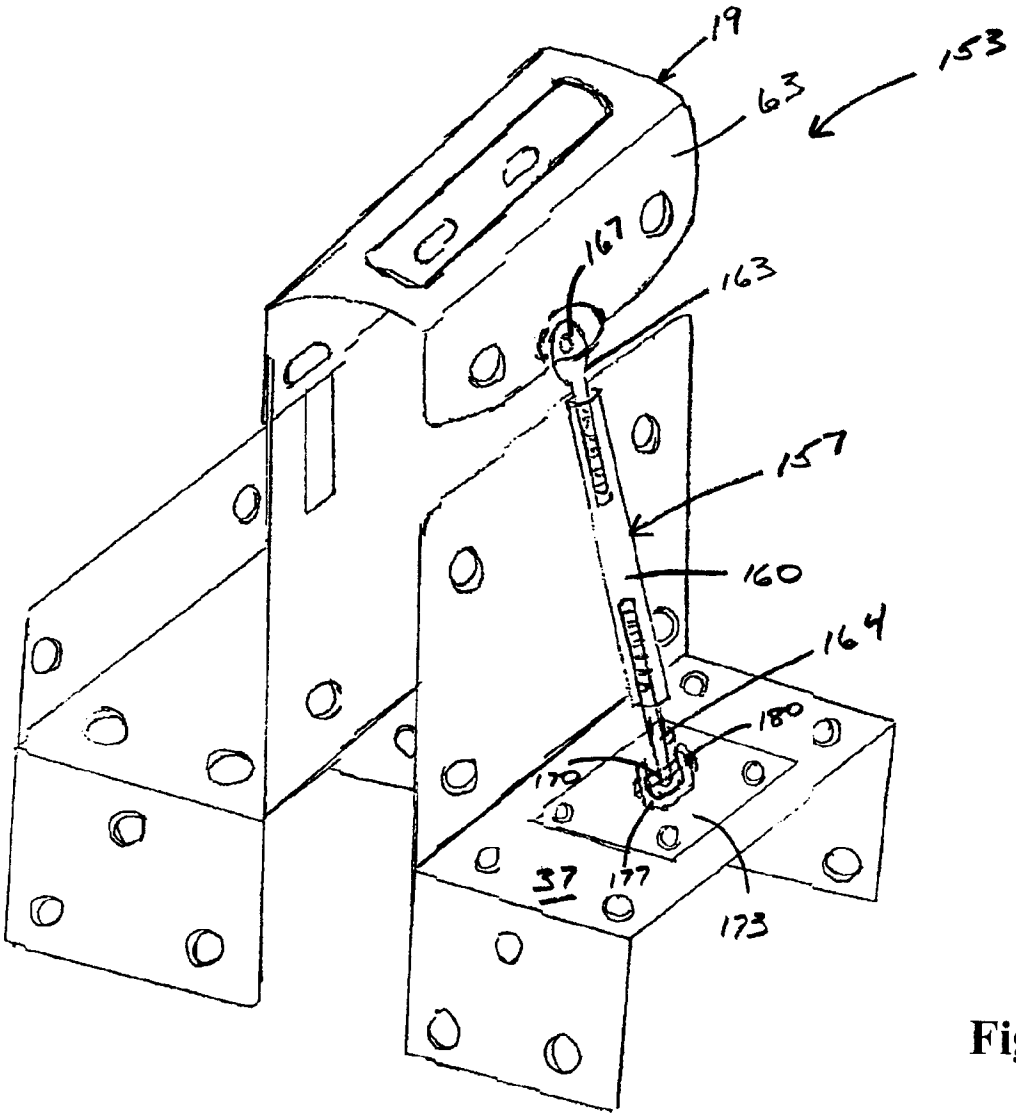
FIG. 4*a* shows an illustration of a roof tie in perspective having a hold-down reinforcement according to one embodiment of the present invention.
Figure 4B:
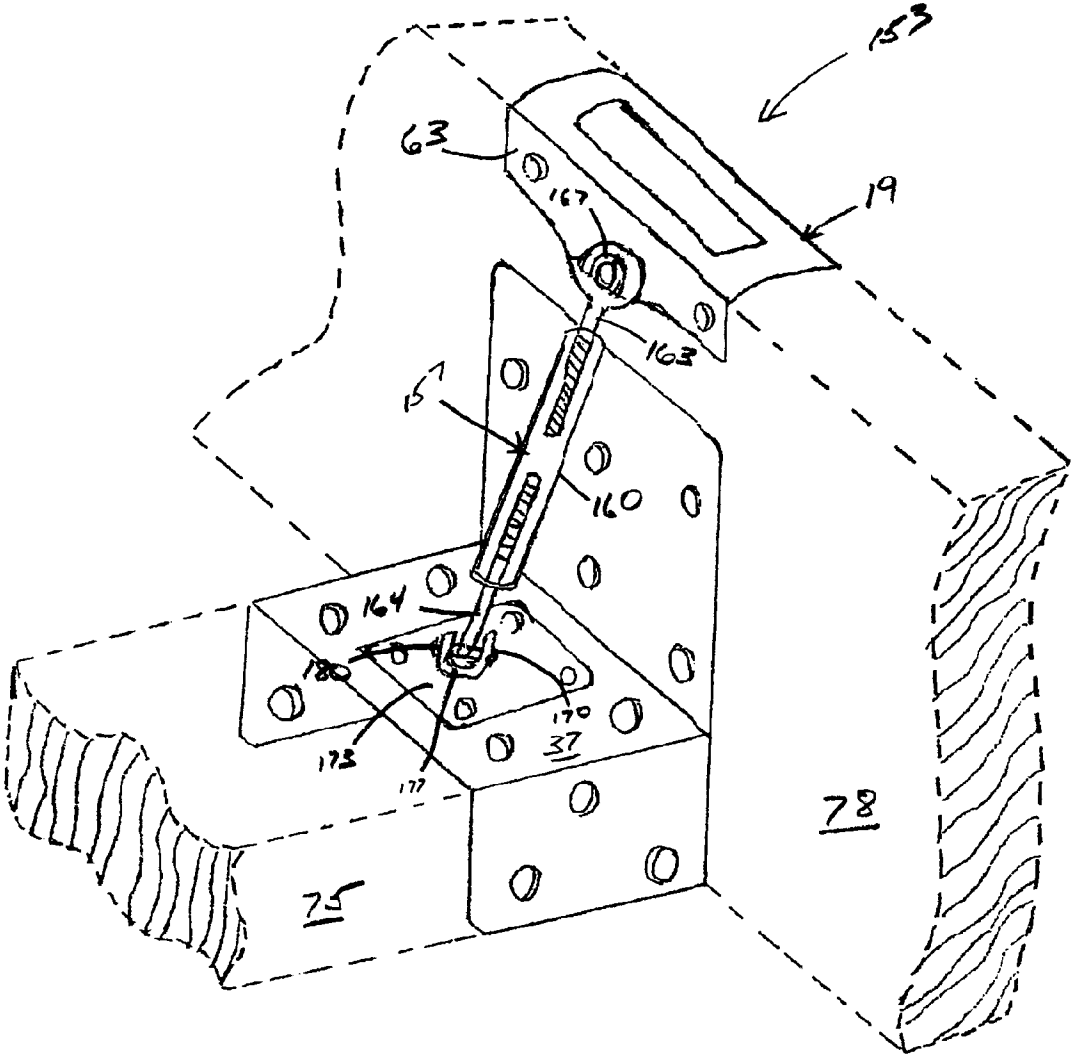
FIG. 4*b* shows an illustration of the roof tie of FIG. 4*a*, with top plate and gable in phantom.

FIGS. 4*a* and 4*b* illustrate an alternate embodiment of a hold-down roof tie, indicated generally as 153, according to the present invention. For heavy-duty applications, hold-down roof tie 153 further comprises turnbuckle 157 attached to bridge component 19 and fastener extension 37. Turnbuckle 157 comprises body 160 having a first threaded portion 163 extending out of the top of such body 160 and a second threaded portion 164 extending out of the bottom of such body 160. The distal end of such first threaded portion 163 terminates in an eye 167 having an opening for attaching to short riser 63 of bridge component 19. Such eye 167 can be attached to short riser 63 and rafter 78 by a suitable fastener such as a nail or lag bolt. In some embodiments, short riser 63 presents a hook on which such eye 167 can be attached.

The distal end of such second threaded portion 164 terminates in an eye or some other fashion having an opening 170. A plate 173 is attached to fastener extension 37 and to top plate 75 by suitable fasteners. A U-shaped connector 177 having a pin 180 passing through the open end of such U-shaped connector 177 projects from the top of such plate 173. The pin 180 passes through the opening 170 on the end of such second threaded portion 164 of such turnbuckle 157.

The alignment of the threads of such first and second threaded portions 163, 164 is configured such that rotation of such body 160 in a first direction about its longitudinal axis causes both such first and second threaded portions 163, 164 to be drawn into such body 160 and rotation of such body 160 in a second, opposite direction about its longitudinal axis causes both such first and second threaded portions 163, 164 to be forced out of such body 160. Such hold-down roof tie 153 provides additional reinforcement against uplift forces encountered in a high wind condition, resulting in a sturdier, stronger tie. Such increased strength can be obtained at reduced cost by enabling use of lower galvanized steel gauges for its construction while providing increased hold-down force.

Figure 5:
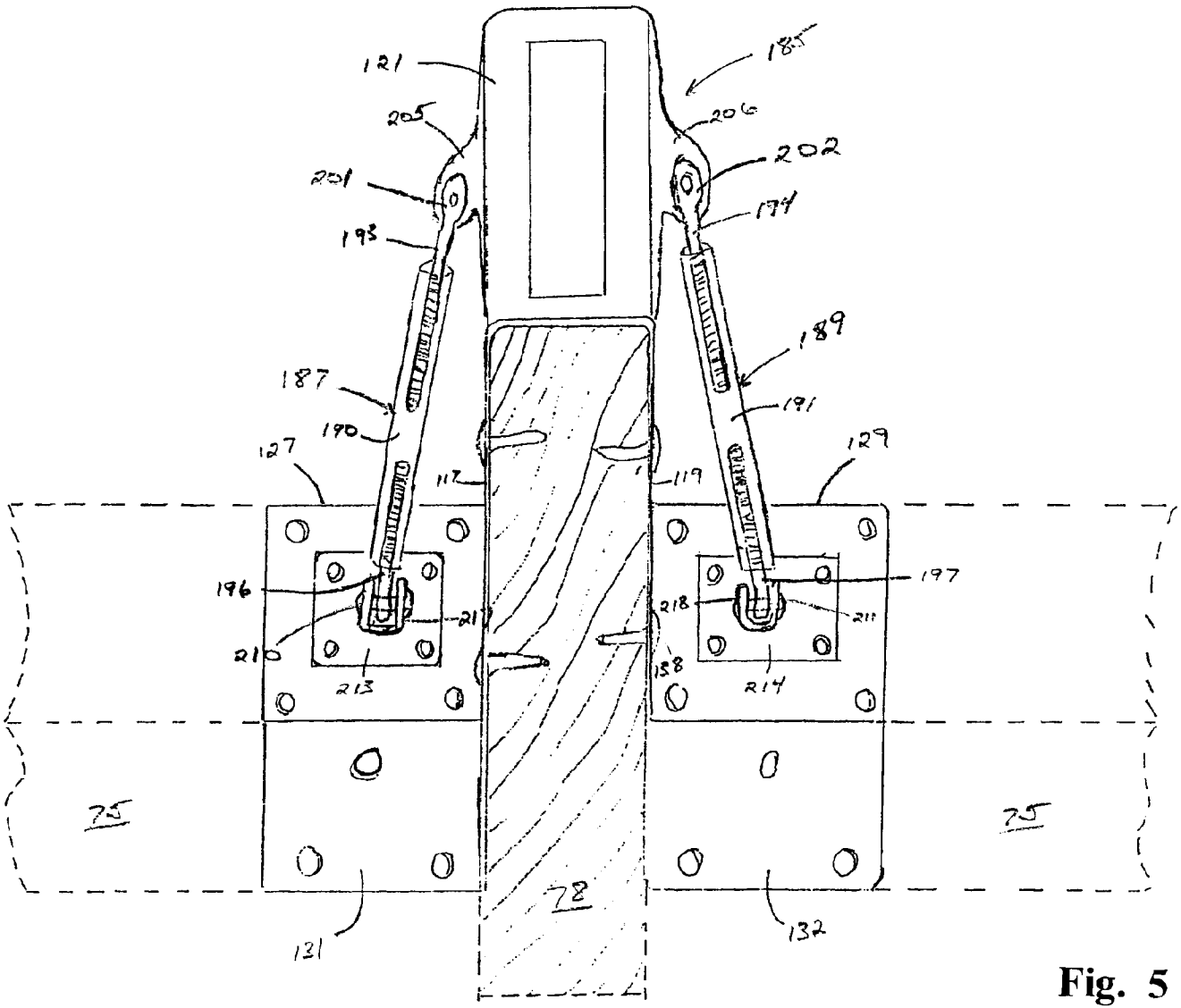
FIG. 5 shows an illustration of a roof tie, according to an alternative to the embodiment in FIGS. 4*a* and 4*b*.

FIG. 5 shows an illustration of an application according to an alternative hold-down roof tie embodiment. Roof tie 185 comprises a pair of matching turnbuckles 187, 189 attached to either side of bridge 121 and fastener extensions 127, 129. Such fastener extensions 127, 129, extend at right angles from risers 117, 119, respectively, each of which fastener extensions 127, 129 further comprise top plate flaps 131, 132, 133 (not shown), 134 (not shown). A plurality of apertures 137 for inserting fasteners, such as nails 138 are disposed on such risers 117, 119, fastener extensions 127, 129, and top plate flaps 131, 132, 133 (not shown), 134 (not shown). Such plurality of apertures should be disposed in a staggered fashion to prevent splitting of the top plates and rafter when inserting such fasteners.

Figure 7:
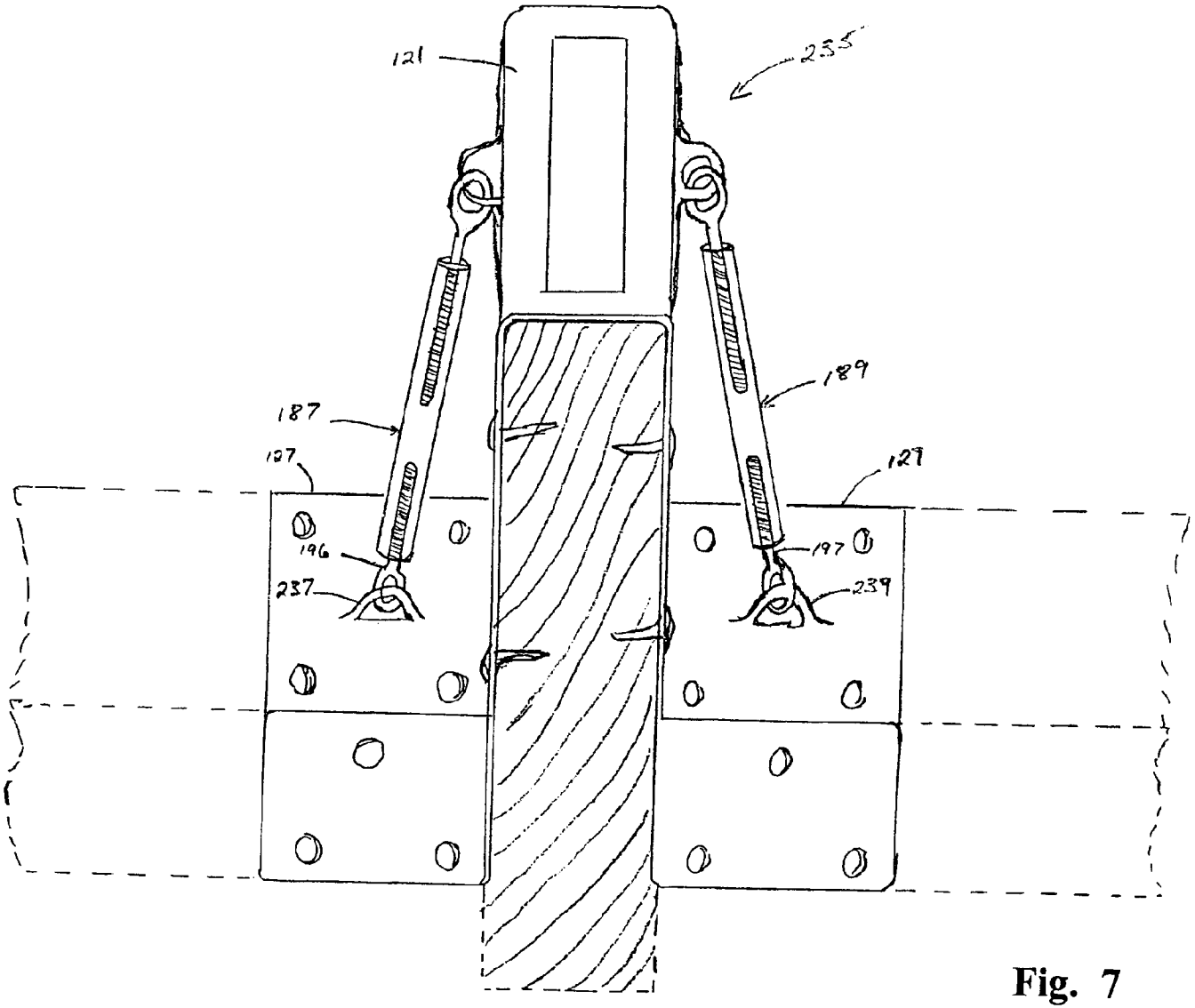
FIG. 7 shows an illustration of a roof tie, according to an alternative to the embodiment in FIG. 6.

Each turnbuckle 187, 189 comprises a body 190, 191 having a first threaded portion 193, 194 extending out of the top of such body and a second threaded portion 1960 197 extending out of the bottom of such body. The distal end of such first threaded portion 193, 194 terminates in an eye 201, 202 having an opening for attaching to a flap 205, 206 extending down from bridge 121. Such eye 201, 202 can be attached to flap 205, 206 and rafter 78 by a suitable fastener such as a nail or lag bolt. In some embodiments, flap 205, 206 presents a hook on which such eye 201, 202 can be attached. In a further embodiment, flap 205, 206 presents a loop engaged with eye 201, 202, as illustrated in FIG. 7.

The distal end of such second threaded portion 196, 197 terminates in an eye or some other fashion having an opening in which a pin 210, 211 passes through. A plate 213, 214 is attached to fastener extensions 127, 129, respectively and to top plate 75 by suitable fasteners. Pin 210, 211 passes through the open end of U-shaped connector 217, 218 that projects from the top of such plate 213, 214.

The alignment of the threads of such first and second threaded portions is configured such that rotation of such body of such turnbuckle 187, 189 in a first direction about its longitudinal axis causes both such first and second threaded portions to be drawn into such body and rotation of such body of such turnbuckle 187, 189 in a second, opposite direction about its longitudinal axis causes both such first and second threaded portions to be forced out of such body. Such hold-down roof tie 185 provides additional reinforcement against uplift forces encountered in a high wind condition, resulting in a sturdier, stronger tie. Such increased strength can be obtained at reduced cost by enabling use of lower galvanized steel gauges for its construction while providing increased hold-down force.

Figure 6:
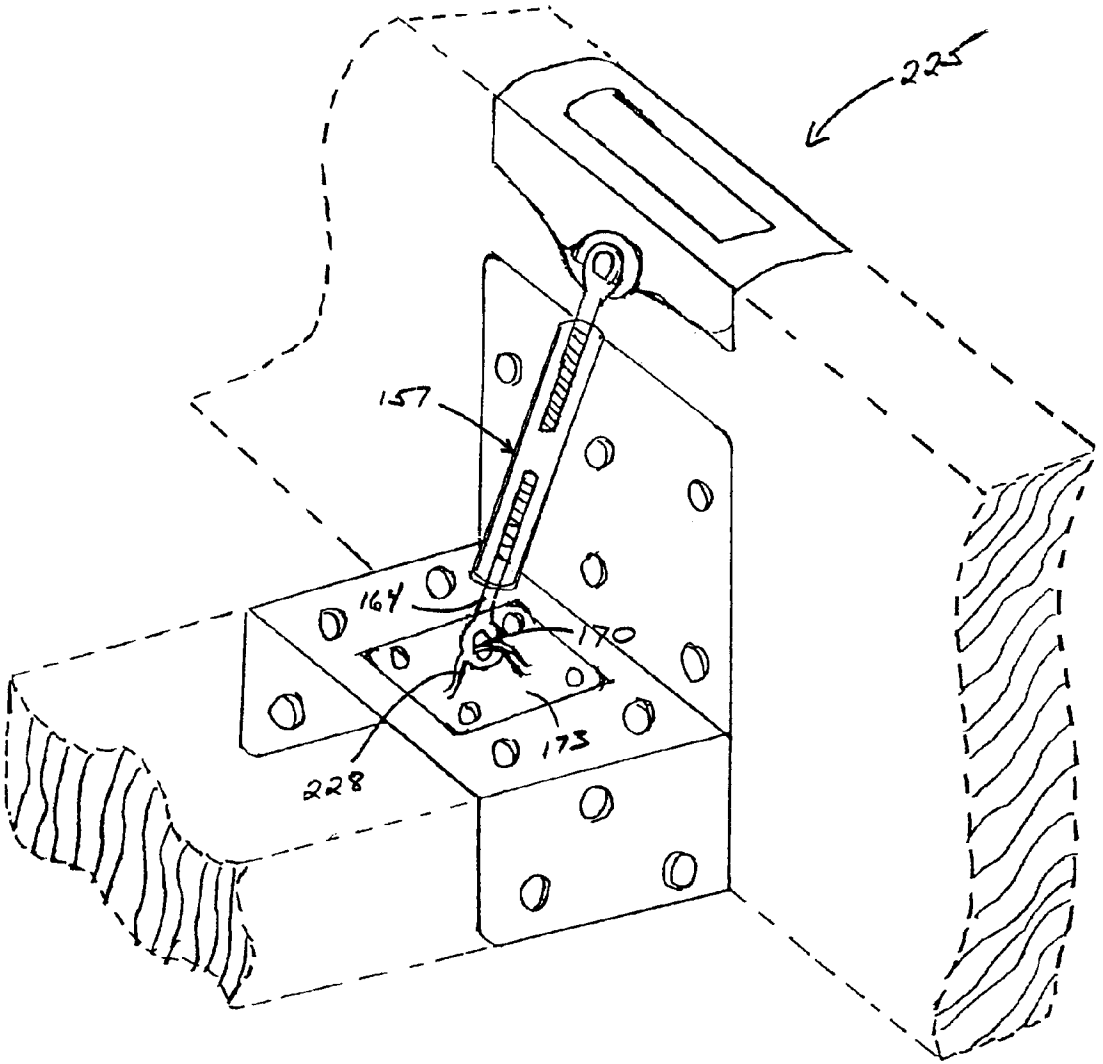
FIG. 6 shows an illustration of an alternate embodiment of a roof tie, with top plate and gable in phantom.

FIG. 6 illustrates an alternate embodiment of a holddown roof tie, indicated generally as 225. Hold-down roof tie 225 further comprises loop 228 rising out of plate 173 for attaching the second threaded extension 164 of turnbuckle 157. The opening 170 in the distal end of the second threaded extension 164 of turnbuckle 157 may be manufactured around loop 228 for added strength. In an alternate embodiment, loop 228 may be bonded to plate 173 by welding or other appropriate means.

FIG. 7 shows an alternate hold-down roof tie configuration. Roof tie 235 comprises a pair of matching turnbuckles 187, 189 attached to either side of bridge 121 and fastener extensions 127, 129. Similar to the embodiment described above with regard to FIG. 6, a loop 237, 239 rises out of fastener extensions 127, 129 for attaching the second threaded extension 196, 197 of turnbuckle 187, 189.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with such underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. A roof tie for connecting wood members in building structures, comprising:

a. a first connector, comprising:
(1) a first substantially horizontal member having a forward edge, a rear edge, an inside edge, and an outside edge;
(2) a pair of flaps extending downwardly at right angles from such forward edge and such rear edge of such first horizontal member, and
(3) a first riser extending substantially vertical at a right angle from such inside edge of such first horizontal member;

b. a second connector, comprising:
(1) a second substantially horizontal member having a forward edge, a rear edge, an inside edge, and an outside edge;
(2) a pair of flaps extending downwardly at right angles from such forward edge and such rear edge of such second horizontal member, and
(3) a wall extending substantially vertical at a right angle from such inside edge of such second horizontal member, and c. a substantially horizontal bridge, comprising:
(1) a second riser on a first side of such bridge substantially perpendicular to such bridge, wherein
i. such second riser is shorter than such first riser; and
(2) an overlap plate on a second side of such bridge substantially perpendicular to such bridge; wherein
i. such overlap plate is pierced by at least one aperture and such wall is pierced by at least one slot for inserting a fastener therethrough, such that such at least one aperture on such overlap plate can align with such at least one slot on such wall when such overlap plate overlaps such wall;

d. such first connector, second connector, and such bridge being adapted for attaching such roof tie to a first roofing member and a second roofing member.

2. The roof tie according to claim 1, further comprising:

means for attaching roof decking to such second roofing member through such bridge.

3. The roof tie according to claim 2, wherein:

such means for attaching roof decking to such second roofing member through such bridge comprises a window area.

4. The roof tie according to claim 1, wherein:

such overlap plate is disposed away from such bridge by a ledge.

5. The roof tie according to claim 1, wherein such second connector further comprises:

a cradle wall extending upwardly at a right angle from such outside edge of such second horizontal member.

6. The roof tie according to claim 5, wherein:

such cradle wall is shorter than such wall of such second connector.

7. The roof tie according to claim 1, further comprising:

a. such first riser having a forward edge and a rear edge, wherein such forward edge is longer than such rear edge;

b. such wall having a forward edge and a rear edge, wherein such forward edge is longer than such rear edge, wherein c. such bridge is angled corresponding to a predetermined roof pitch.

8. The roof tie according to claim 1, further comprising:

a plate having a wing member extending substantially perpendicular therefrom, (1) such plate being attached to such riser, and (2) such wing member being attached, on its bottom edge to such first horizontal member.

9. The roof tie according to claim 8, wherein:

such plate is slidably attached to such riser.

10. The roof tie according to claim 8, such second riser further comprising attachment means, such plate further comprising:

a centrally located elongated opening such that such elongated opening can align with such attachment means when such plate overlaps such second riser.

11. The roof tie according to claim 10, such attachment means further comprising:

an aperture for inserting a fastener therethrough.

12. The roof tie according to claim 10, such attachment means further comprising:

a hook.

13. The roof tie according to claim 1, such second riser further comprising a first attachment means, such roof tie further comprising:

a turnbuckle having a first threaded portion and a second threaded portion, (1) such first threaded portion being attached to such second riser; and (2) such second threaded portion being attached to such first horizontal member.

14. The roof tie according to claim 13, such first attachment means further comprising:

an aperture for inserting a fastener therethrough.

15. The roof tie according to claim 13, such first attachment means further comprising:

a hook.

16. The roof tie according to claim 13, such turnbuckle further comprising:

an opening on the end of such first threaded portion for attaching to such first attachment means.

17. The roof tie according to claim 13, further comprising:

a second attachment means connected to such first horizontal member.

18. The roof tie according to claim 17, such turnbuckle further comprising:

an opening on the end of such second threaded portion for attaching to such second attachment means.

19. The roof tie according to claim 18, such second attachment means further comprising:

a. a U-shaped connector projecting from the top of such first horizontal member; and b. a pin passing through the open end of such U-shaped connector and passing through such opening on the end of such second threaded portion of such turnbuckle.

20. The roof tie according to claim 18, such second attachment means further comprising:

a loop projecting from the top of such first horizontal member, such loop passing through such opening on the end of such second threaded portion of such turnbuckle.

* * * * *